United States Patent [19]

Schmidt

[11] 4,233,039

[45] Nov. 11, 1980

[54] POWER SUPPLY FOR AN ELECTRIC PRECIPITATOR

[75] Inventor: Walter Schmidt, Uttenreuth, Fed. Rep. of Germany

[73] Assignee: Siemens Aktiengesellschaft, Munich, Fed. Rep. of Germany

[21] Appl. No.: 887,135

[22] Filed: Mar. 16, 1978

[30] Foreign Application Priority Data

Mar. 28, 1977 [DE] Fed. Rep. of Germany ..... 2713675

[51] Int. Cl.[3] ..... B03C 3/02

[52] U.S. Cl. ..... 55/139; 307/2

[58] Field of Search ..... 307/56, 2; 363/139; 55/139, 123, 136, 137

[56] References Cited

U.S. PATENT DOCUMENTS

| | | | |
|---|---|---|---|
| 3,075,136 | 1/1963 | Jones | 363/139 |
| 3,641,740 | 2/1972 | Schumann | 55/139 |

*Primary Examiner*—John Gonzales

*Assistant Examiner*—S. D. Schreyer

*Attorney, Agent, or Firm*—Kenyon & Kenyon

[57] ABSTRACT

An improved power supply for an electric precipitator which includes a d-c voltage source and a pulsed a-c voltage source coupled to the high-voltage electrodes of the precipitator. The improvement of the invention comprises the pulsed a-c voltage source comprising a high-voltage transformer including a primary winding and a secondary winding, the latter of which is coupled to the high-voltage electrodes of the precipitator. A d-c voltage source has one of the voltage terminals thereof coupled by means of a center tap to the primary winding of the transformer and the other of its voltage terminals coupled to a pair of thyristors and a pair of diodes connected to the ends of the primary winding of the transformer. The thyristors are coupled in anti-parallel relationship with the diodes and are adapted to be triggered in alternating fashion at the frequency of the voltage pulses desired to be generated.

2 Claims, 1 Drawing Figure

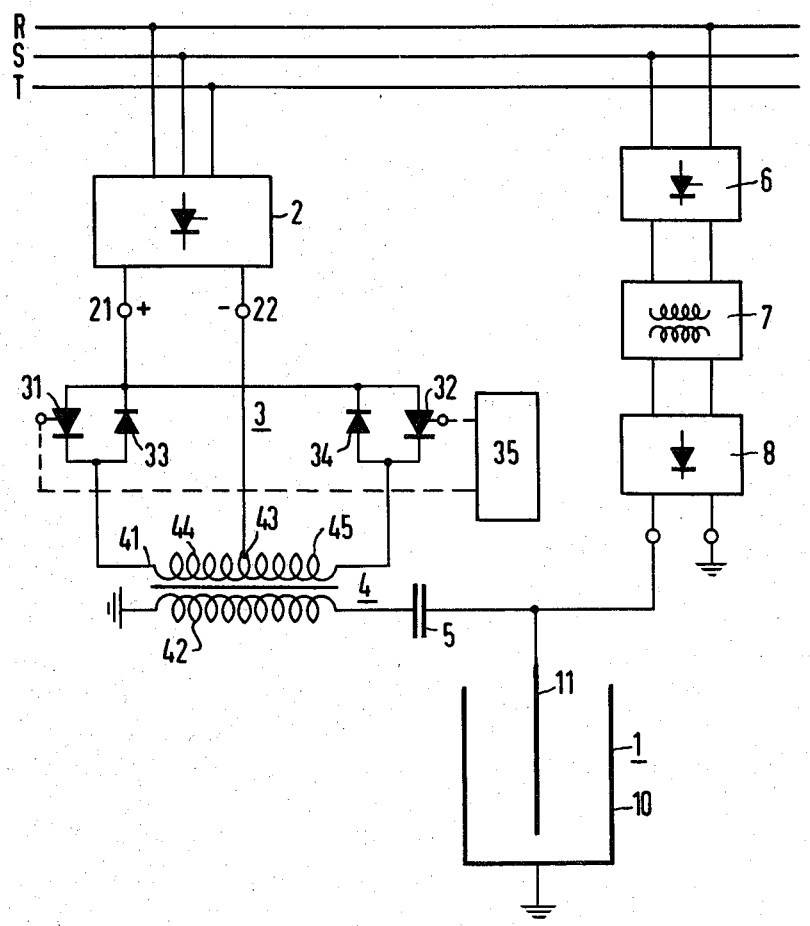
R
S
T
2
6
7
8
21
+
-
22
31
32
33
34
3
35
41
44
43
45
4
42
5
11
1
10

POWER SUPPLY FOR AN ELECTRIC PRECIPITATOR

BACKGROUND OF THE INVENTION

1. Field of the Invention

This invention relates generally to a power supply for an electric precipitator which includes a d-c voltage source and a pulsed a-c voltage source coupled to the high-voltage electrodes of the precipitator.

2. Description of the Prior Art

Power supplies of the foregoing type are known in the art. See, for example, the journal "Staub", 1976, pages 19 through 26. In the power supply described in this publication, high-votage a-c pulses and a d-c voltage are fed to separate electrodes of a precipitator. However, it is also possible to superimpose both voltages upon each other by decoupling the voltage sources from each other by means of a transformer or capacitor. See German Offenlegungsschrift No. 2, 341, 541. The supplemental use of a pulsed a-c voltage increases, in both cases, the degree of ionization of the gas to be purified and thereby improves the precipitation effect.

Power supplies of the aforesaid type have only been slowly introduced into practice and the reason for this is the high cost of generating pulsed a-c voltages with a high pulse repetition frequency at the voltages and power levels required, particularly if the electrical data are to be variable. Considering the large number of equipments required, ordinary inverters are much too expensive for this purpose.

SUMMARY OF THE INVENTION

It is therefore an object of the present invention to provide an improved power supply for an electric precipitator which overcomes the aforementioned disadvantages of heretofore known power supplies and to provide a pulsed a-c voltage source for such a power supply which is simple in design and the pulse repetition frequency of which can be set within wide limits, for example, from 50 Hz to 2 kHz.

These and other objects of the invention are achieved in a power supply for an electric precipitator, the power supply including a d-c voltage source and a pulsed a-c voltage source coupled to the high-voltage electrodes of the precipitator. The improvement comprises the pulsed a-c voltage source comprising a high-voltage transformer including a primary winding and a secondary winding, the secondary winding being coupled to the high-voltage electrodes; a d-c voltage source having positive and negative voltage terminals, one of which is coupled by means of a center tap to the primary winding of the transformer; first and second thyristors, coupled to the ends of the primary winding and to the other of the voltage terminals, and adapted to be triggered in alternating fashion at the frequency of the voltage pulses desired to be generated; and first and second diodes coupled to the ends of the primary winding and to the other of the voltage terminals in anti-parallel relationship with the first and second thyristors.

The pulsed a-c voltage source of the invention has the advantage that a separate quenching device for the thyristors is unnecessary since the precipitator, which is a substantially capacitive load, in conjunction with the high-voltage transformer, extinguishes the thyristor coupled to one end of the primary transformer winding when the thyristor coupled to the other end of the primary winding is fired.

If the pulsed a-c voltage and the d-c voltage are applied to the same precipitator electrode, a capacitor is preferably coupled to one end of the secondary transformer winding and to the electrodes in series relationship therewith to decouple both voltages from each other in order to avoid saturation of the transformer. It may also be advantageous to couple additional capacitors in parallel relationship to the primary transformer winding and/or the secondary transformer winding to optimize the circuit, although the magnitude of the capacitance is relatively uncritical. It is also possible to replace each thyristor by a parallel circuit and/or series circuit by thyristors or similarly acting switching elements.

These and other novel features and advantages of the invention will be described in greater detail in the following detailed description.

BRIEF DESCRIPTION OF THE DRAWING

The drawing is a schematic diagram of an improved power supply for an electric precipitator constructed according to the present invention.

DETAILED DESCRIPTION

Referring now to the drawing, there is shown a precipitator 1 consisting of a grounded plate electrode 10 and a high-voltage electrode 11. The high-voltage electrode 11 is connected to the R and S transmission lines of a three-phase network RST by means of a rectifier 8, a high-voltage transformer 7, and an a-c control element 6 coupled in series relationship, and is in this manner supplied with a high d-c voltage.

The network RST is also connected to a controlled rectifier circuit 2 which generates a d-c voltage at the terminals 21 and 22. An alternative d-c voltage source could be diode rectifiers coupled to a d-c control element in series relationship. The negative terminal 22 of the rectifier circuit is connected to a center tap 43 of the primary winding 41 of a high-voltage transformer 4. The ends 44 and 45 of the primary winding are connected to the positive terminal 21 of the rectifier circuit 2 by a pair of thyristors 31 and 32, which can be alternately triggered at the desired pulse frequency by a trigger circuit 35. A pair of diodes 33 and 34 are connected to the ends of primary winding 41 and to positive voltage terminal 21 in anti-parallel relationship with the thyristors. The secondary winding 42 of transformer 4 is grounded at one end and is similarly connected to electrode 11 by a coupling capacitor 5.

If thyristor 31 is fired by trigger circuit 35, current flows in the primary winding 41 of the transformer 4 and generates a pulse-shaped voltage signal in the secondary transformer winding 42 which is transmitted to electrode 11 of the precipitator. If thyristor 32 is then fired by trigger circuit 35, the hitherto current-conducting thyristor 31 is extinguished by the substantially capacitive load of precipitator 1 in conjunction with transformer 4, and current is conducted by thyristor 32.

This process is repeated in a similar manner if thyristor 31 is fired. By coupling a capacitor in parallel relationship to primary winding 41, the charge reversal and quenching of the thyristors at the time they are current-conducting can also be forced. Through a suitable choice of the firing pulse sequences at thyristors 31 and 32, it is therefore possible to apply a pulse voltage of high amplitude to the electrode 11 which can be set within relatively wide limits, for example, from 50 Hz to 2 kHz.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a power supply for an electric precipitator, said power supply including a d-c voltage source and a pulsed a-c voltage source coupled to the high-voltage electrodes of said precipitator, the improvement comprising said pulsed a-c voltage source comprising a high-voltage transformer including a primary winding and a secondary winding, said secondary winding being coupled to said high-voltage electrodes;

a d-c voltage source having positive and negative voltage terminals, one of which is coupled by means of a center tap to said primary winding of said transformer;

first and second thyristors, coupled to the ends of said primary winding and to the other of said voltage terminals, and adapted to be triggered in alternating fashion at the frequency of the voltage pulses desired to be generated; and first and second diodes coupled to the ends of said primary winding and to the other of said voltage terminals in anti-parallel relationship with said first and second thyristors.

2. The improvement recited in claim 1, further comprising a coupling capacitor coupled to one end of said secondary winding and to said high-voltage electrodes in series relationship therewith.

* * * * *